United States Patent [19]

Köpcke

[11] Patent Number: 4,736,499

[45] Date of Patent: Apr. 12, 1988

[54] EQUIPMENT FOR UNRAVELING THREADS FROM A FABRIC

[75] Inventor: Hermann Köpcke, Viersen, Fed. Rep. of Germany

[73] Assignee: Thomas Josef Heimbach GmbH & Co., Duren, Fed. Rep. of Germany

[21] Appl. No.: 829,991

[22] Filed: Feb. 18, 1986

[30] Foreign Application Priority Data

Mar. 2, 1985 [DE] Fed. Rep. of Germany ..... 3507450

[51] Int. Cl.[4] ..... D03D 3/04

[52] U.S. Cl. ..... 28/141

[58] Field of Search ..... 28/141, 142, 145, 146, 28/170

[56] References Cited

U.S. PATENT DOCUMENTS 2,845,686 8/1958 Mason ..... 28/142 X 3,885,596 5/1975 Alexeff ..... 28/141 X

FOREIGN PATENT DOCUMENTS 2130741 12/1972 Fed. Rep. of Germany ..... 28/141

51-3829 2/1976 Japan ..... 28/170

*Primary Examiner*—Robert R. Mackey

*Attorney, Agent, or Firm*—Shlesinger, Arkwright & Garvey

[57] ABSTRACT

Equipment for unraveling threads out of a fabric, in particular cross-threads in the end areas of fabrics produced for papermaking machines, comprising an unraveling assembly including a sensor head for determining the precise course of cross-threads to be removed, an unraveling head transversely displaceable with respect to the cross-threads and having at least one unraveling needle capable of vertical reciprocation into and out of the fabric for capturing and lifting a cross-thread out of the fabric, needle reciprocation means for selective vertical reciprocation of the unraveling needle and cutter means for selectively cutting off cross-thread ends lifted out of the fabric by the unraveling needle. The equipment further includes support means for mutually supporting the unraveling assembly and the fabric in working relationship, tracking control means including means for transversely displacing the unraveling head corresponding to the path of cross-threads to be removed as ascertained by the sensor head and longitudinal displacement means operably associated with the unraveling assembly for providing a stepwise relative displacement between the fabric and the unraveling assembly in the longitudinal direction of the cross-threads to be removed.

19 Claims, 4 Drawing Sheets

EQUIPMENT FOR UNRAVELING THREADS FROM A FABRIC

BACKGROUND OF THE INVENTION

The invention concerns equipment for unraveling threads from a fabric, in particular cross-threads in the end areas of the fabrics of papermaking machines.

Frequently a so-called spiral seam is used to join the ends of the fabrics of paper-making machines (H. Kerber, nahtprobleme an Trockensieben und -Filzen, Wochenblatt fuer papierfabrikation, p 817–820 [1969], Nr. 19). To make such seams, a set of cross-threads each spaced from the two end edges of the fabric is removed so that only lengthwise threads remain in this area. A plastic spiral is then placed in each place into these longitudinal threads and across the entire width of the fabric of the papermaking machine. Thereupon the particular fabric part is folded over between the spiral and the end edge and sewed together with the remaining part of the fabric. Thereupon the spirals form the edges of the two fabric ends. The spiral seam is closed by the two spirals being inserted into each other so far that a so-called slip-in wire can be inserted into the eyelets so formed.

While in many a way the spiral seam has been found advantageous, its implementation however does remain time-consuming, with the removal of the cross-threads—called unraveling—being especially costly in time. This is still done by hand using an unraveling needle. By means of such an unraveling needle, cross-threads are pulled, parts at a time, out of the fabric and then are cut by hand. As a rule, several of these cross-threads must be unraveled, and furthermore the fabrics of papermaking machines frequently are more than 10 m wide, so that the unraveling takes a very long time. Furthermore, this is a much monotonous and hence psychologically undesirable work which is rendered more difficult in that the position of the body is disadvantageous but can be hardly changed. Lastly, the eyes tire very rapidly because the thin threads are hard to spot. These fatigue phenomena entail other health problems such as headaches and the like.

OBJECTS AND SUMMARY OF THE INVENTION

It is therefore the object of the invention to substantially make easier the labor of unraveling threads from a fabric, in particular the cross-threads near the ends of the fabrics of papermaking machines.

This problem is solved by the invention by means of equipment which practically automatically takes charge of unraveling the threads. For that purpose, the apparatus includes an unraveling apparatus with a sensor head to determine the precise path of the thread(s) to be removed, further an unraveling head movable transversely to these threads and with at least one unraveling needle which can move into the fabric and further with a cutter to sever the thread end(s) raised by the unraveling needle(s) out of the fabric. Provision is furthermore made for a tracking control for the transverse motion of the unraveling head corresponding to the path(s) of the thread(s) determined by the sensor head and for a system for the stepwise relative motion between fabric and unraveling apparatus in the longitudinal direction of the thread(s) to be removed.

It is now possible by means of such equipment to automatically unravel threads out of a fabric. The sensor head assures that the unraveling needle(s) having passed from the unraveling head into the fabric accurately pick(s) up the thread(s) and remove(s) it (them) from the fabric. The cutter then removes the pulled-out ends of the thread(s), this process repeating itself stepwise in the longitudinal direction, i.e. in the direction of the threads to be removed. All that is left to do for the operator is to so mutually arrange the fabric and the apparatus at the beginning that the desired threads will be picked up by the unraveling needle(s). The laborious, health adverse manual work of pulling out the cross-threads is eliminated entirely.

In one embodiment of the invention, the unraveling head and the cutter can be moved jointly in the transverse direction so that both will always be in the same relative position. Additionally, however, the sensor head also shall be displaceable jointly with the unraveling head and the cutter in the transverse direction, and, in the simplest manner by the fact that the unraveling apparatus as a whole is transversely displaceable. The sensor head, unraveling head and cutter are mounted serially in the longitudinal direction so that the sensor head accurate moves along those threads which must be unraveled.

In another embodiment of the invention, the unraveling apparatus is mounted on a base displaceable in the longitudinal direction and provided with a fabric holder. This holder appropriately includes a clamp means extending parallel to the longitudinal direction and allowing to fix the fabric. Illustratively the clamp may consist of a support for the fabric and of clamping yoke lowered on this support, for instance a rubber-clad roller.

Additionally and preferably, the holder includes support pads for the rolled-up part of the fabric.

Various implementations are possible for the sensor head. Because two threads running next to each other within a fabric form a slight channel, the invention provides for mechanical sensing of that channel. This can be carried out, for instance, by a sensor needle matching the particular requirements, which is suspended to be movable in the transverse direction and enters the channel between two threads. In that case, the transverse motion during sensing is detected by a displacement sensor connected to the tracking control. In this manner it is possible to make the unraveling needle(s) follow the path of the threads to be removed.

The invention provides a support without play to suspend the sensor needle from a horizontal carriage guide. To allow the sensor to also move vertically, this horizontal carriage guide is also suspended from a corresponding vertical carriage guide which is driven pneumatically. The compression of the sensor needle on the fabric can be set by a pressure regulator.

Lastly, a reset system to set the sensor needle at a defined null point is provided and consists appropriately of two pneumatic cylinders laterally acting on the carriage guide.

Another feature of the invention is that the unraveling head includes at least one depressor means which can be lowered on the fabric and enclosing at least in part the unraveling needle(s). This depressor keeps the fabric in place when the thread(s) is (are) pulled out. Upon further step operation, the depressor is lifted again.

Appropriately the unraveling head has several unraveling needles longitudinal offset with respect to each other and moving jointly into the fabric. In this manner it is possible in one operation to unravel a desired number of threads, i.e. the unraveling apparatus need pass only once over the fabric.

The cutter of the invention comprises a cutting head with cutting blades moving to and from in the transverse direction. The cutting head is provided with a number of cutting grooves corresponding to the number of the unraveling needles, so that one cutting groove is available for each thread that was pulled out, the thread in this motion moving into the longitudinal direction of that groove.

The distance between the unraveling needle(s) and the cutter must not exceed the distance covered when the unraveling apparatus moves stepwise once in the longitudinal direction.

Lastly, the invention provides a suction system for the cutter to remove the cut-off thread ends.

The drawing further illustrates the invention by means of an embodiment.

DETAILED DESCRIPTION OF THE DRAWINGS

Figure 1:
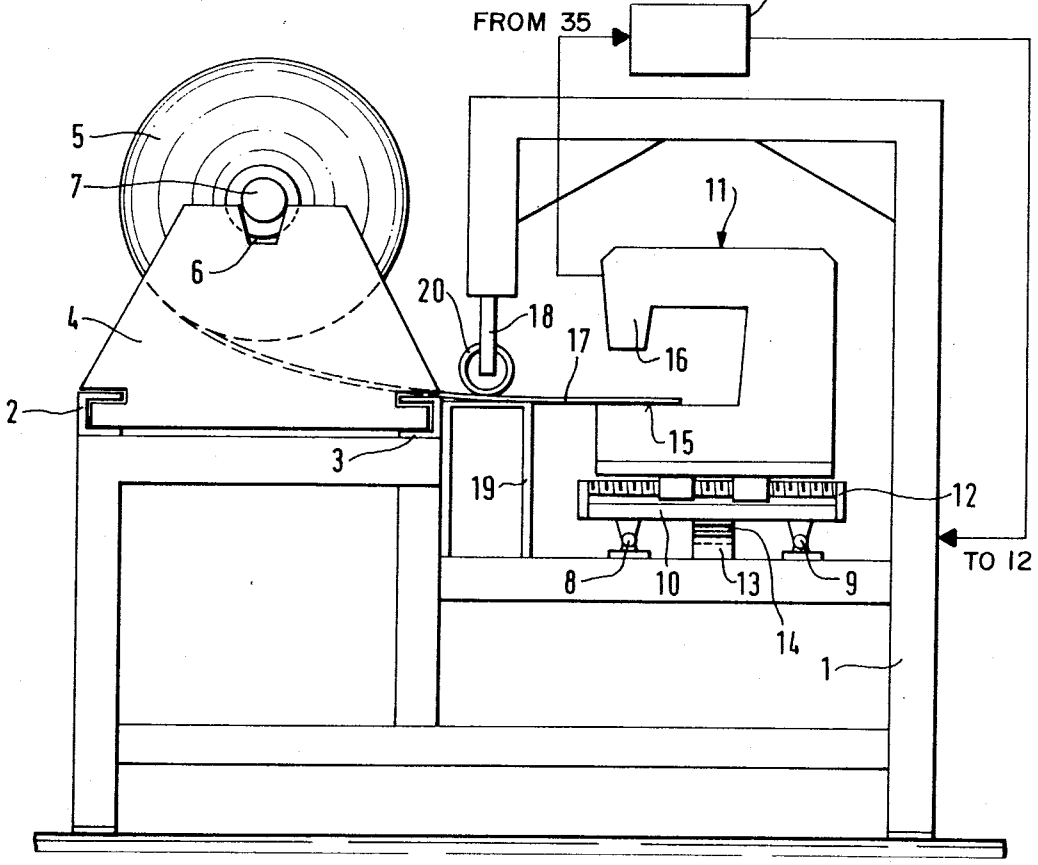
FIG. 1 is a sideview of the equipment for unraveling threads from a fabric.

The equipment shown in FIG. 1 includes a machine stand 1 perpendicular to the plane of the drawing. Two U-rails 2, 3 are laid flat and mutually apart on the left side of this view of the machine stand 1. These rails 2, 3 also extend perpendicularly to the plane of the drawing. Bearing blocks 4 are displaceably inserted in the longitudinal direction of these U-rails 2,3 but only one is shown in this figure, namely the front one. A fabric roll 5 rests on these bearing blocks 4 by means of a journal 7 at each end entering a clearance 6 of the bearing block 4. Bearing blocks 4 are displaceably mounted for adjustment purposes, i.e., to accommodate different fabric roll widths.

Two guide rails 8,9 are mounted mutually spaced apart on the right side of the machine stand 1 and perpendicularly to the plane of the drawing, and support a mechanical stage 10. An unraveling apparatus 11 is mounted on the mechanical stage 10. This apparatus 10 can be moved transversely, i.e. in the plane of the drawing, by means of a ball-thread drive 12. In the longitudinal direction, i.e. in the direction of the guide rails 8,9, the motion of the mechanical stage 10 together with the unraveling apparatus 11 takes place by means of a gear rack 13 extending in the direction of the guide rails 8, 9 and engaged by a gear 14 driven by a motor for the unraveling apparatus 11. The drive can be a disk-rotor motor with assembled gear. Gear 14 is intermittently driven by its motor to produce a stepwise motion of unraveling apparatus 11 in the longitudinal direction as more fully described hereinafter. Again a DC motor is provided for the transverse motion.

The unraveling apparatus has a bed 15 and an unraveling head 16. The end area of a fabric length 17 pulled off the fabric roll 5 rests on the bed 15. The unraveling head 16 located above includes tools for sensing and for unraveling threads out of the fabric piece 17, said parts being omitted for the sake of clarity from FIG. 1 but shown in FIG. 2 in closer detail. The fabric segment 17 is fixed in place by a clamp means 18 mounted between the bearing block 4 and the unraveling apparatus 11 and consisting of a support 19 and a vertically displaceable clamping roller 20. The clamping roller is clad with a sheet of rubber and secured against rotation. The clamping roller 20 can be displaced in the vertical direction by means of hydraulic or pneumatic cylinders mounted within the machine stand 1.

Figure 2:
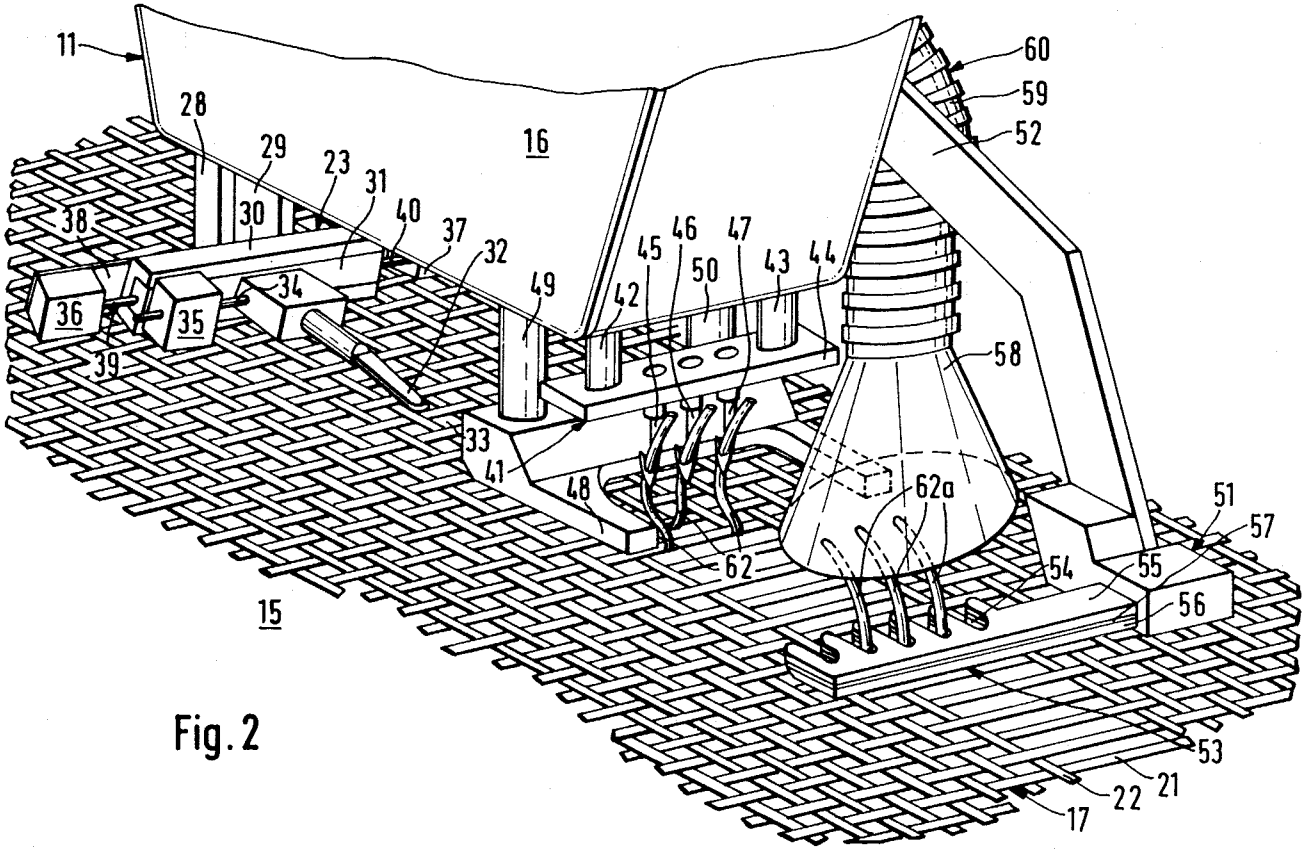
FIG. 2 is a perspective of the sensor head, the unraveling head, the cutter and the suction system of the apparatus of FIG. 1.

FIG. 2 shows a cutaway of the unraveling apparatus 11 with its support 19, the fabric part 17 laid on it and the unraveling head 16 above. The fabric part 17 is woven, of longitudinal threads illustratively denoted by 21 and of cross-threads illustrated by 22, into a tabby weave, the thicknesses of the longitudinal and cross threads, and their separations not being to scale. The longitudinal threads 21 are called that way because running lengthwise, and as regards a papermaking machine fabric, in the direction of motion of the fabric, whereas the cross-threads 22 run transversely and therefore parallel to a seam in the fabric connecting its two ends. As regards the directions of motion of the unraveling apparatus 11 in the machine stand 1, the longitudinal threads run transversely and the cross-threads lengthwise.

Figure 3:
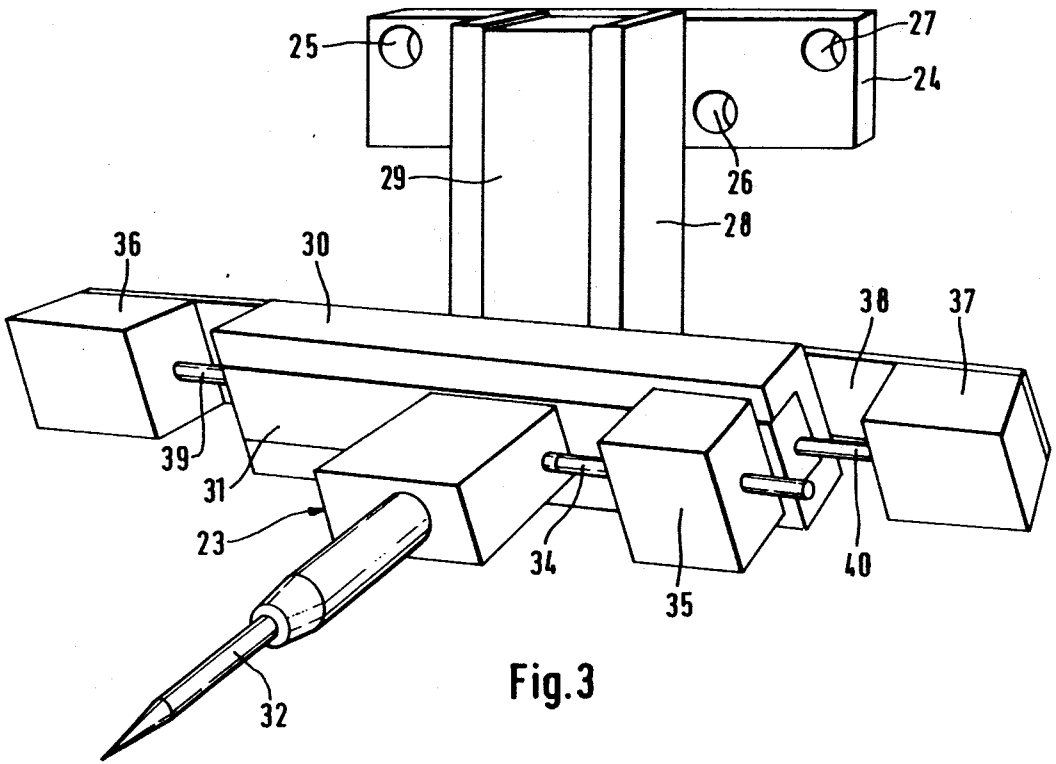
FIG. 3 is a perspective of the sensor head of FIG. 2.

Seen in the longitudinal direction, a sensor head 23 is mounted at the front of the unraveling head 16 and is shown on a larger scale in FIG. 3. Only the latter Figure shows its mounting plate 24 with screw holes 25, 26, 27 by means of which the sensor head 23 is fastened to the unraveling head 16. The upper end of a vertical carriage guide 28 in the form of a torque guide is mounted to the mounting plate 24. Its carriage 29 is guided without play and can be displaced vertically by means of pneumatics not shown herein in further detail.

A horizontal carriage guide 30 is mounted to the lower end of the carriage 29 and its carriage 31 too is guided without play and is horizontally displaceable. A sensor needle 32 is mounted to the carriage 31, its front tip being shaped to allow entering a channel 33 between two cross-threads 22.

Any horizontal motion of the sensor needle 32 during the motion through the channel 33 bounded by the two cross-threads 22 is transmitted to a pickup pin 34 connected to the sensor needle 32 and passing through a linear displacement sensor 35 mounted to the horizontal carriage guide 30 but not to its carriage 31. In the embodiment of FIG. 2, the pickup pin 34 and the displacement sensor 35 are mounted on the left side of the sensor needle 32 and in the embodiment of FIG. 3 they are mounted on the right side; the operation however remains unaffected by their relative positions. The displacement sensor 35 detects the particular position of the pick-up pin 34 and thereby of the sensor needle 32 and feeds it to an electronic tracking control. This tracking control assures a corresponding opposite motionp—in the event of deviations by the sensor needle 32—of the unraveling apparatus 11 so that the sensor needle 32 be retained as close as possible to the null position at all times. In this manner the entire unraveling apparatus 11 is made to track a preselected channel 33: this is important in the operation of the unraveling apparatus 11.

One miniature pneumatic cylinder each, 36, 37, is mounted on each side of the ends of the carriage 29 and connected by a sheet metal strip 38 to the horizontal carriage guide 30. They can be supplied on both sides from compressed air lines whereby small piston rods 39, 40 projecting from them can be reciprocated horizontally. When fully extended against stops not visible here, the free ends of the piston rods 39, 40 rest against the two end faces of the carriage 31 and in this manner determine its null position. Then the sensor needle 32 can be set to the particular channel 33 by transversely displacing the unraveling apparatus 11. Thereupon the piston rods 39, 40 are retracted by corresponding reversal of the miniature pneumatic cylinders 36, 37 so that the carriage 31 is free to move.

An unraveling head 41 is mounted behind the sensor head 23. The unraveling head 41 has two vertically displaceable guide rods 42 and 43 which also are actuated pneumatically. A needle-holding plate 44 is mounted to their lower ends and supports a total of three unraveling needles 45, 46, 47 mounted next to each other in the transverse direction. A depressor 48 is mounted in front of the unraveling head 41 and can be displaced vertically by means of the guide rods 49, 50, again pneumatically. The depressor assumes a U-shape and laterally frames the set of unraveling needles 45, 46, 47.

A cutter 51 is mounted behind the unraveling head 41 and is held by a holding yoke 52 close to the surface of the fabric 17. It includes a cutting head 53 with a total of five cutting grooves illustratively denoted by 54. The cutting head 53 consists of two identical plates mounted to the holding yoke 52 and of a cutting blade 57 of similar shape which reciprocates transversely between said plates. Cutting blade 57 is actuated for reciprocation on an intermittent basis during the stepwise advancement of the unraveling assembly. A suction stub 58 is located above the cutting head 53 together with a hooked-up suction hose 59, both stub and hose being part of a suction system 60. The suction system 60 may be operated on a continuous basis.

Figure 4:
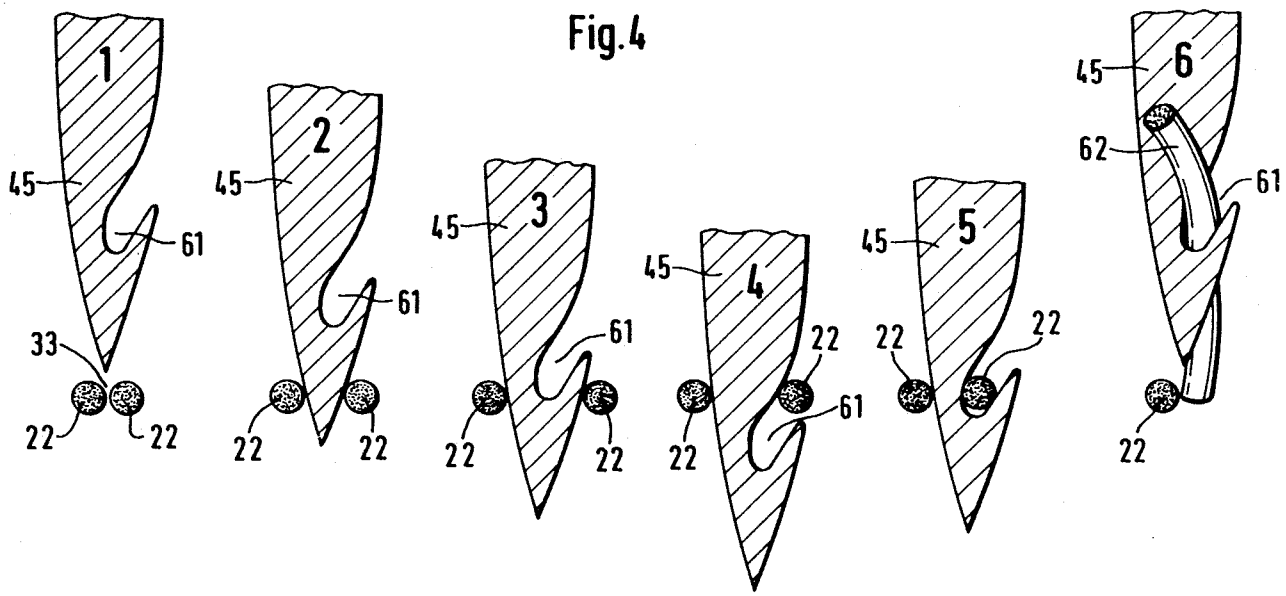
FIG. 4 is a cross-section of a fabric with unraveling needle showing the unraveling principle.

The operation of the sensor head 23, unraveling head 41, depressor 48, cutter 51 and suction system 60 when unraveling the cross-threads 22 is as follows:

After the unraveling apparatus 11 has been moved a specified amount in the longitudinal direction by motor driven gear 14, it is stopped. Then the depressor 48 is moved down on the fabric 17. Simultaneously the unraveling needles 45, 46, 47 are moved into the gaps between the cross-threads 22. This procedure is shown in detail in relation to the unraveling needle 45 in FIG. 4. In this case, the plane of cutting is transverse to the cross-threads 22, to adjacent cross-threads 22 being shown in each case. For position 1, the tip of the unraveling needle 45 is precisely above the channel 33 formed by the two cross-threads 22. From the tip up, the unraveling needle 45 widens toward a downward notch 61 shown in this figure starting at the right edge of the unraveling needle 45, the purpose of which is to catch the cross-thread 22 which in each case is to the right. This is carried out by a further lowering of the unraveling needle 45, whereby the two cross-threads 22 are driven apart as shown by the positions 2 and 3. The unraveling needle 45 is at its lowest position at "4". The right cross-thread 22 of this view is in front of the notch 61, with forces directed at each other and due to the displacement effect of the unraveling needle 45 acting on both cross-threads. As a result, the cross-thread 22 shown on the right in this Figure moves into the notch 61 when the unraveling needle 45 is being raised and thereby is caught in it as shown by the position 5. As the unraveling needle 45 is raised further, the right cross-thread 22 is lifted and its free end 62 is pulled out of its lacing to the longitudinal threads 21. These states are shown both by the position 6 of FIG. 4 and the representation of Fig. 2. Therein, all three unraveling needles 45, 46, 47 are in the raised position, pulling up the ends 62 of three cross-threads 22.

Thereupon the depressor 48 too is raised again and the entire unraveling apparatus 11 is moved in the longitudinal direction, i.e. in the direction of the cross-threads 22, by a specific distance. In the process, the ends 62 of the cross-threads 22 slip out of the unraveling needles 45, 46, 47 and are caught by the cutting grooves 54 of the cutting head 53 which is approaching because of the motion of the unraveling apparatus 11. This is shown in closer detail in FIG. 2 by the representation of the end segments 62*a*, this situation coming into being only after the unraveling apparatus 11 has been moved so far in the longitudinal direction that the cutting head 53 assumes that position which is still that of the unraveling needles 45, 46, 47 as shown in the Figure. The ends 62 of the cross-threads 22 are cut off by a transverse motion of the cutting blade 57 and then are immediately evacuated through the suction stub 58 and the suction hose 59. Thereupon a new unraveling process starts, i.e. the depressor 48 and the unraveling head 41 are lowered again after a corresponding advance in order to pull further ends of the cross-threads 22 out of the fabric 17. In this manner, the unraveling apparatus 11 operates stepwise until the three cross-threads 22 have been removed piece by piece. The unraveling apparatus 11 always is so guided in the transverse direction by the sensor head 23 that the unraveling needles 45, 46, 47 always have their lips between the same two cross-threads 22.

The electronic tracking control could be part of an overall control system designated by box 66 in FIG. 1. The overall control system would be designed so as to selectively activate and deactivate the electric and fluid motor drives associated with the various individual components of the unraveling apparatus in order to achieve the automated sequence of operation as previously described.

Control system 66 would control operation of the electric motors responsible for activating ball-thread drive 12 and gear 14 for respectively, transverse and longitudinal movement of unraveling apparatus 11. In addition, control system 66 would control sequential operation of the fluid motors associated with guide rods 42 and 43 for needle reciprocation and guide rods 49 and 50 for reciprocation of depressor 48. Intermittent reciprocation of cutting blade 57 would likewise be under the control of control system 66.

The tracking control of overall control system 66 would receive input from displacement sensor 35 and would cause activation of ball-thread drive 12 to transversely move unraveling apparatus 11 as required for proper tracking.

If more than three cross-threads 22 must be removed, then the unraveling apparatus 11 can be displaced transversely correspondingly after having unraveled the first three cross-threads 22, whereby the further cross-threads 22 can be unraveled after the unraveling apparatus 11 has been displaced longitudinally. Alternatively, of course more than three unraveling needles 45, 46, 47 can be provided, it being recommended then that they be arranged to be longitudinally offset to avoid excessive crowding of the fabric when entered by the unraveling needles 45, 46, 47.

I claim:

1. Equipment for unraveling threads out of a fabric, in particular cross-threads in the end areas of fabrics produced for papermaking machines, comprising:

(a) an unraveling assembly including a sensor head for determining the precise course of cross-threads to be removed, an unraveling head transversely displaceable with respect to said cross-threads and having at least one unraveling needle capable of vertical reciprocation into and out of the fabric for capturing and lifting a cross-thread out of the fabric, needle reciprocation means for selective vertical reciprocation of said unraveling needle and cutter means for selectively cutting off cross-thread ends lifted out of the fabric by said unraveling needle, (b) equipment support means for mutually supporting said unraveling assembly and the fabric in working relationship, (c) tracking means including means transversely displacing said unraveling head, said tracking means for controlling transverse displacement of said unraveling head corresponding to the path of cross-threads to be removed as ascertained by said sensor head, and (d) longitudinal displacement means operably associated with said unraveling assembly for providing a stepwise relative displacement between the fabric and said unraveling assembly in the longitudinal direction of the cross-threads to be removed.

2. Equipment as in claim 1, wherein:

(a) said unraveling head and said cutter means are jointly displaceable transversely with respect to the cross-threads.

3. Equipment as in claim 1, wherein:

(a) said sensor head, said unraveling head and said cutter means to are jointly displaceable transversely with respect to the cross-threads.

4. Equipment as in claim 3, wherein:

(a) said sensor head, said unraveling head and said cutter means are mutually serially arranged in the longitudinal direction.

5. Equipment as in claim 1, wherein:

(a) said equipment support means including a machine stand for supporting said unraveling assembly for transverse longitudinal displacement thereon, and (b) said machine stand including fabric supporting means.

6. Equipment as in claim 5, wherein:

(a) said fabric supporting means including adjustable bearing blocks for adjustably supporting a wound-up roll of the fabric, and (b) said fabric supporting means further including fabric clamping means for clamping against movement an end portion of the fabric unwound from the roll of fabric.

7. Equipment as in claim 6, wherein (a) said clamping means including a fabric supporting base member for horizontally supporting an end portion of the fabric unwound from the fabric roll, (b) a vertically displaceable clamping roller for clamping a horizontally support unwound end portion of the fabric on said supporting base member, and (c) clamping roller displacement means for causing vertical displacement of said clamping roller relative to said supporting base member.

8. Equipment as in claim 1, wherein:

(a) said sensor head including a sensor needle longitudinally displaceable by said longitudinal displacement means, said sensor needle entering and traveling longitudinally in a channel formed between two adjacent cross-threads of the fabric, (b) means for suspending said sensor needle in a transversely displaceable manner relative to the cross-threads, (c) a displacement sensor operably associated with said sensor needle during longitudinal travel of said sensor needle within the channel, and (d) said displacement sensor being connected with said tracking means.

9. Equipment as in claim 8, wherein said needle suspending means comprises:

(a) a first carriage supporting said sensing needle, and (b) said first carriage being supported for transverse displacement by a horizontal carriage guide.

10. Equipment as in claim 9, wherein:

(a) said horizontal carriage guide being suspended from a second carriage, (b) said second carriage being supported for vertical movement by a vertical carriage guide, and (c) drive means associated with said second carriage for vertically displacing said second carriage relative to said vertical carriage guide.

11. Equipment as in claim 10, wherein:

(a) said drive means being pneumatic.

12. Equipment as in claim 10, wherein:

(a) said sensing head including a reset system for setting said sensing needle at a specified null position.

13. Equipment as in claim 12, wherein:

(a) said reset system including a pair of pneumatic cylinders laterally acting upon opposite ends of said first carriage to position said first carriage in said horizontal carriage guide at a pre-determined null position.

14. Equipment as in claim 1, wherein:

(a) said unraveling assembly including at least one vertically reciprocable depressor operably associated with said unraveling needle, (b) said depressor at least partially enclosing said unraveling needle, and (c) depressor drive means connected to said depressor for vertically reciprocating said depressor into and out of contact with the fabric.

15. Equipment as in claim 1, wherein:

(a) said unraveling head including a plurality of simultaneously reciprocable, longitudinally mutually offset unraveling needles.

16. Equipment as in claim 1, wherein:

(a) said cutter means including a cutting head, (b) a transversely reciprocable cutter blade supported by said cutting head, and (c) cutter blade drive means operably associated with said cutter blade for causing transverse reciprocation of said cutter balde.

17. Equipment as in claim 16, wherein:

(a) said cutting head being provided with a number of spaced apart grooves for receiving cross-threads to be cut, and (b) said number of grooves corresponding to the number of unraveling needles.

18. Equipment as in claim 16, wherein:

(a) said unraveling needle being spaced a pre-determined distance from said cutting head, the distance not exceeding the distance travelled by said unraveling assembly relative to the fabric during each stepwise longitudinal advancement of said unraveling assembly in the longitudinal direction of the cross-threads to be removed.

19. Equipment as in claim 1, wherein:

(a) a suction system is operably associated with said cutter means for evacuating thread ends cut off by said cutter means.

* * * * *